US007758379B2

(12) United States Patent
Chen

(10) Patent No.: US 7,758,379 B2
(45) Date of Patent: Jul. 20, 2010

(54) ELECTRICAL CONNECTOR WITH FIRST AND SECOND TERMINAL ASSEMBLIES

(75) Inventor: Wan-Tien Chen, Taipei (TW)

(73) Assignee: WonTen Technology Co., Ltd., Taipei (TW)

( * ) Notice: Subject to any disclaimer, the term of this patent is extended or adjusted under 35 U.S.C. 154(b) by 23 days.

(21) Appl. No.: 12/272,302

(22) Filed: Nov. 17, 2008

(65) Prior Publication Data

US 2009/0156027 A1 Jun. 18, 2009

(30) Foreign Application Priority Data

Nov. 16, 2007 (TW) ..... 96219368 U

(51) Int. Cl.
*H01R 13/648* (2006.01)

(52) U.S. Cl. ..... 439/607.11; 439/660; 439/607.4

(58) Field of Classification Search . 439/607.31–607.4, 439/660, 607.09, 607.11, 607.13
See application file for complete search history.

(56) References Cited

U.S. PATENT DOCUMENTS 5,073,130 A * 12/1991 Nakamura ..... 439/607.32
5,169,324 A * 12/1992 Lemke et al. ..... 439/101
5,256,074 A * 10/1993 Tan et al. ..... 439/108
5,342,220 A * 8/1994 Kodama ..... 439/607.4
5,356,313 A * 10/1994 Niwa et al. ..... 439/607.4
5,507,655 A * 4/1996 Goerlich ..... 439/108
5,685,739 A * 11/1997 Davis et al. ..... 439/607.38
6,074,225 A * 6/2000 Wu et al. ..... 439/101
6,447,340 B1 * 9/2002 Wu ..... 439/660
6,960,089 B2 * 11/2005 Lee et al. ..... 439/79
6,986,681 B2 * 1/2006 Tsai ..... 439/607.36
7,097,507 B1 * 8/2006 Zhang et al. ..... 439/607.35
7,179,127 B2 * 2/2007 Shiu ..... 439/607.35
7,578,705 B2 * 8/2009 He et al. ..... 439/660
7,670,156 B2 * 3/2010 Chen ..... 439/108

* cited by examiner

*Primary Examiner*—Neil Abrams
(74) *Attorney, Agent, or Firm*—Guice Patents PLLC

(57) ABSTRACT

The present invention discloses an electrical connector comprising: a housing; a base body having a tongue, whose one surface is disposed with a plurality of first terminal slots and whose other surface is disposed with a plurality of second terminal slots; a first terminal assembly whose each first terminal is disposed with a leg and a contact portion perpendicular to the leg, respectively, with the legs being alternately arranged; and a second terminal assembly whose each second terminal is disposed with a leg and a contact portion perpendicular to the leg and then bending downward, respectively. For the first terminal assembly the legs of every third terminal are offset from the remaining ones. The terminals of one assembly may be e-SATA type and those of the other assembly may be USB type.

15 Claims, 4 Drawing Sheets

ELECTRICAL CONNECTOR WITH FIRST AND SECOND TERMINAL ASSEMBLIES

FIELD OF THE INVENTION

The present invention relates to an electrical connector, and more particularly to an electrical connector in which the legs of one of its terminal assemblies are alternately arranged in a front/rear fashion to provide wiring with larger spacing when layout is being conducted.

BACKGROUND OF THE INVENTION

An electrical connector; for example, but not limited to, IEEE1394, SATA, or e-SATA connector; has parallel legs so as to enable layout between legs. ROC Patent of Utility Models, 095221982, 095201553, 095201362, and 095212401, all disclose such an electrical connector.

However, the emerging trend in microminiaturization and complicated functioning for electrical connectors, the distance between legs is becoming so small that PCB layout is impossible. Therefore, the layout has to be detour and thus it has become ever more complicated, and in turn the size and cost of PCB has to be increased. Thus, the drawback has significantly restricted the application electrical connector, and further improvements are needed.

SUMMARY OF THE INVENTION

In view of the foregoing shortcomings of the prior art, the inventor of the present invention based on years of experience in the related industry to conduct extensive researches and experiments, and finally invented an electrical connector in accordance with the present invention.

One objective of the present invention is to provide an electrical connector, in which the legs of its first terminal assembly are alternately arranged in a front/rear fashion to provide wiring with larger spacing when layout is being conducted and in turn to cut down cost.

The other objective of the present invention is to provide an electrical connector, in which a ground piece is disposed in the tongue of the body base to enhance electrical properties and prevent electrostatic discharge from occurring.

To achieve the aforementioned objects, an electrical connector according to the present invention comprises: a housing having a receiving space; a base body received in the receiving space and disposed with a tongue, whose one surface is disposed with a plurality of first terminal slots and whose other surface is disposed with a plurality of second terminal slots; a first terminal assembly having a plurality of first terminals, which are received in the first terminal slots, respectively, and which are disposed with a leg and a contact portion slightly perpendicular to the leg, respectively, with the legs being alternately arranged; and a second terminal assembly having a plurality of second terminals, which are received in the second terminal slots, respectively, and which are disposed with a leg and a contact portion slightly perpendicular to the leg and then bending downward, respectively.

To make it easier for our examiner to understand the objective of the invention, its structure, innovative features, and performance, we use a preferred embodiment together with the attached drawings for the detailed description of the invention.

DETAILED DESCRIPTION OF THE PREFERRED EMBODIMENTS

Figure 1:
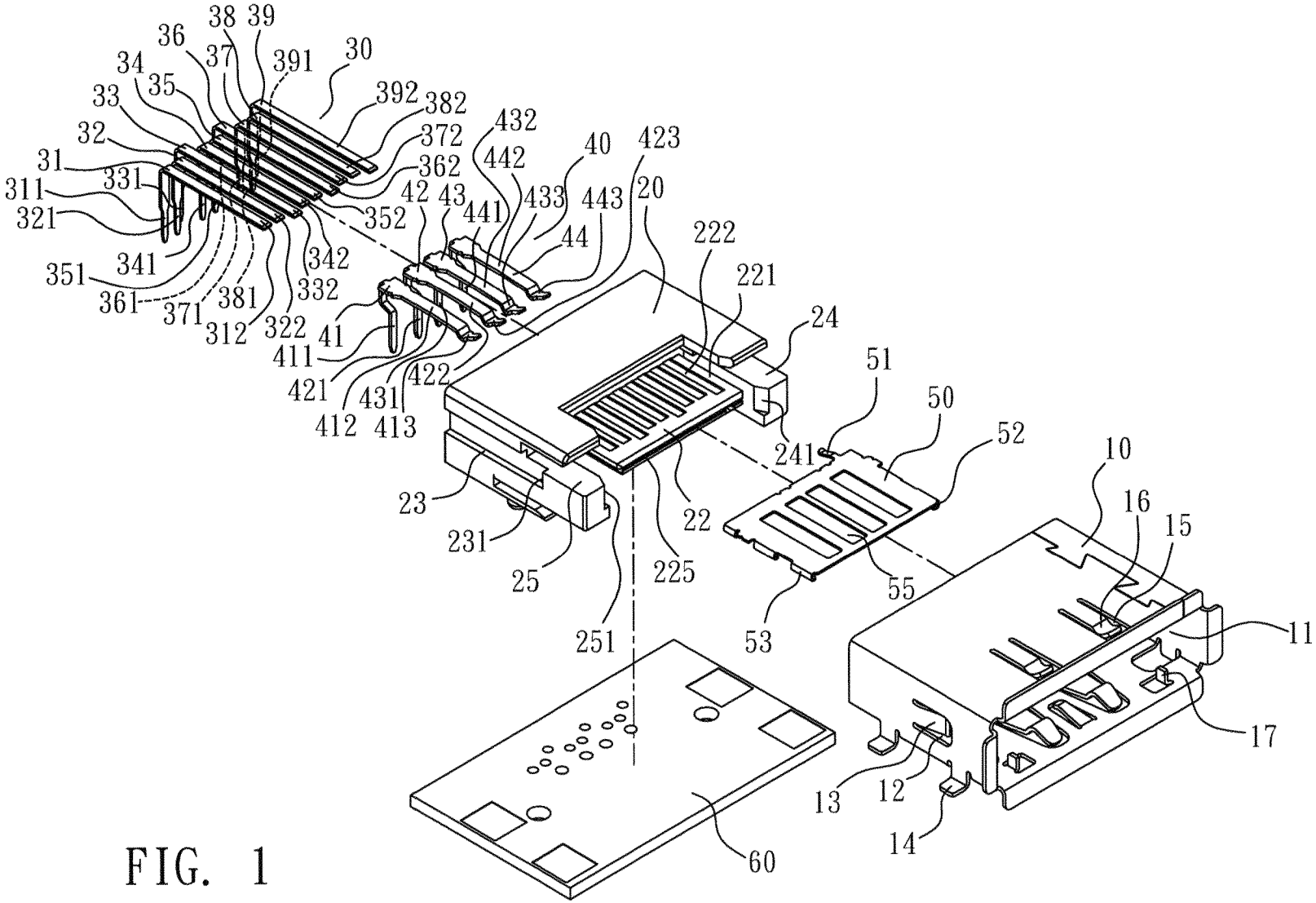
FIG. 1 is an exploded perspective view of a preferred embodiment of an electrical connector in accordance with the present invention.

The structure, technical measures and effects of the present invention will now be described in more detail hereinafter with reference to the accompanying drawings that show various embodiments of the invention.

With reference to the figures, an electrical connector according to the present invention comprises, a housing 10, a base body 20, a first terminal assembly 30, and a second terminal assembly 40, wherein the housing 10 has a receiving space 11. The housing 10 is made of, for example but not limited to, metal, which is a conventional art and will not be described here furthermore. The two sidewalls of the housing 10 are formed to have a first opening 12, respectively, from which a retaining portion 13 is formed by bending inward. Also, the bottom of the two sidewalls of the housing 10 is further disposed with at least a welding piece 14 on each side, which may be further connected onto a printed circuit board 60 to enhance the retaining strength. Furthermore, the upper and lower walls of the housing 10 are formed to have a second opening 15, respectively, from which a ground finger 16 is formed by bending inward. Also, the left and right sides of the lower wall of the housing 10 is disposed with a restricting piece 17, respectively.

The base body 20 is received in the receiving space 11 and it is preferably made of insulating material and has a tongue 22, whose one surface 221 is disposed with a plurality of first terminal slots 222 and the other surface 223 is disposed with second terminal slots 224. A gap 225 is formed in the middle of the tongue 22. The first terminal slots 222 are, for example, formed on the upper surface 221 of the tongue 22, but not limited to be formed on the upper surface 221. The second terminal slots 224 are, for example, formed on the lower surface 223 of the tongue 22, but not limited to be formed on the lower surface 223. Also, the two sides of the base body 20 are disposed with a guide slot 23, respectively, whose one end is formed to have a stopper 231. The guide slot 23 may guide the retaining portion 13 to be fixedly retained at the stopper 231. Furthermore, the guide slot 23 may be formed to have a restricting portion 232 near the stopper 231. The restricting portion 232 may accommodate the retaining portion 13 as well as prevent the retaining portion 13 from moving backward.

The first terminal assembly 30 is, for example but not limited to, the terminal assembly of e-SATA (External Serial ATA), and has a plurality of first terminals 31 to 39, which are received in the first terminal slots 222, respectively. Every third first terminal of the first terminals, 33, 36, and 39, are alternately arranged in a top/bottom fashion with respect to other first terminals 31, 32, 34, 35, 37, and 38; wherein for the first terminals on the top, the first terminals 33, 36, and 39 are ground terminals and the first terminal 31 is, for example but not limited to, a power terminal; and the first terminal 32, 34, 35, 37, and 38 on the bottom are, for example but not limited to, signal terminals. Consequently, an e-SATA terminal assembly of the present invention may also provide power, which is a conventional art and will not be discussed here furthermore. Also, the first terminals 31 to 39 are further disposed with legs 311 to 391 and contact portions 312 to 392 slightly perpendicular to the legs 311 to 391, respectively. The legs 311 to 391 are alternately arranged, for example but not limited to, in a front/rear manner, such that the legs 311 to 391 have larger spacing therebetween for layout.

The second terminal assembly 40 are, for example but not limited to, the terminal assembly of USB (Universal Serial BUS) or IEEE 1394. In the present embodiment, the second terminal assembly 40 is taken as an USB terminal assembly for the purpose of illustration. The second terminal assembly 40 has a plurality of second terminals 41 to 44, which are received in the second terminal slots 224. The plurality of the second terminals 41 to 44 has a ground terminal, signal terminals, and a power terminal, wherein the ground terminal is, for example but not limited to, the terminal 44. Each second terminal 41 to 44 is further disposed with a leg 411 to 441 and a contact portion 412 to 442 slightly perpendicular to the leg 411 to 441 and then bending downward, respectively. Furthermore, the other ends of the contact portions 412 to 442 are bended downwardly to form a stopping portion 413 to 443, respectively. The legs 411 to 441 of the second terminals 41 to 44 may be formed inside with respect to the legs 311 to 391 of the first terminals 31 to 39. The legs 411 to 441 may be alternately arranged in a front/rear fashion or parallel arranged. The arrangement may be determined according to the actual demand, and the parallel arrangement is adopted in the present embodiment for the purpose of illustration.

Furthermore, an electrical connector according to the present invention may further be disposed with a ground piece 50, which may be embeddingly inserted at the gap 225 of the tongue 22, whose, for example but not limited to, front right end extends downward to form a contact portion 51, which is further contacted with one of the ground terminal of the terminal assemblies described above to achieve the function of grounding and electrostatic discharge (ESD) prevention. Also, two sides of the ground piece 50 are further disposed with inserting edges 52 and 53, respectively, which may be embeddingly engaged on the two sides of the tongue 22, such that the ground piece 50 is fixedly retained onto the tongue 22. Also, the ground piece 50 may be further formed to have a plurality of openings 55 to cut down the material used.

Figure 2A:
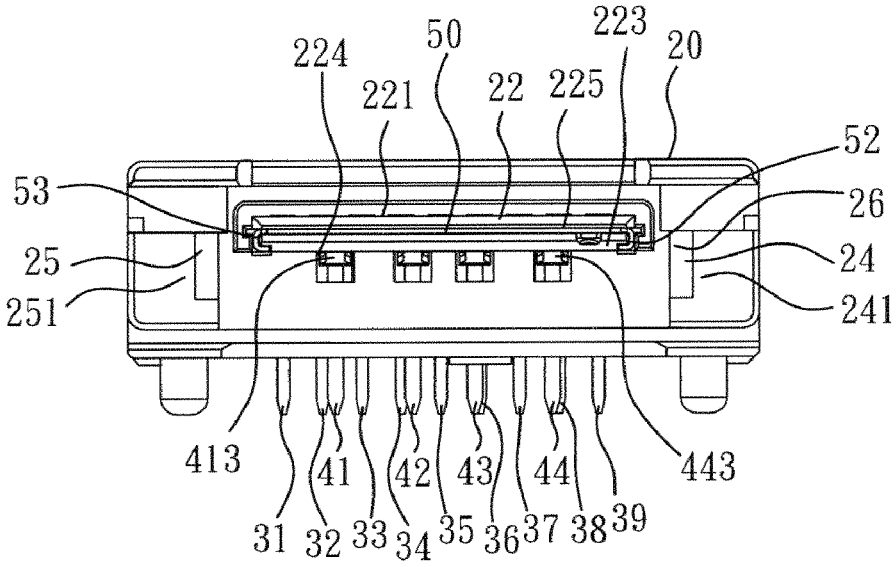
FIG. 2*a* is the front view of the legs of the first terminal assembly alternately arranged in a front/end fashion after the base body, the first terminal assembly, and the second terminal assembly being assembled in accordance with the present invention.

With reference to FIG. 2*a*, after the base body 20, the first terminal assembly 30, and the second terminal assembly 40 being assembled, it is clear that each of the first terminals 31 to 39 of the first terminal assembly 30 is received in the first terminal slots 222, and the legs 311-391 extend downward and perpendicularly to protrude out of the rear of the housing 10. Also, the legs 311 to 391 are alternately arranged in front/rear fashion such that the spacing between the legs 311 to 391 is larger to provide wiring with more space and higher flexibility when layout is being conducted. Furthermore, the base body 20 is disposed with steps 24 and 25 on two sides of the tongue 22, respectively, and the steps 24 and 25 are formed to have chamfers 241 and 251, respectively, to provide guiding and restricting functions.

Figure 2B:
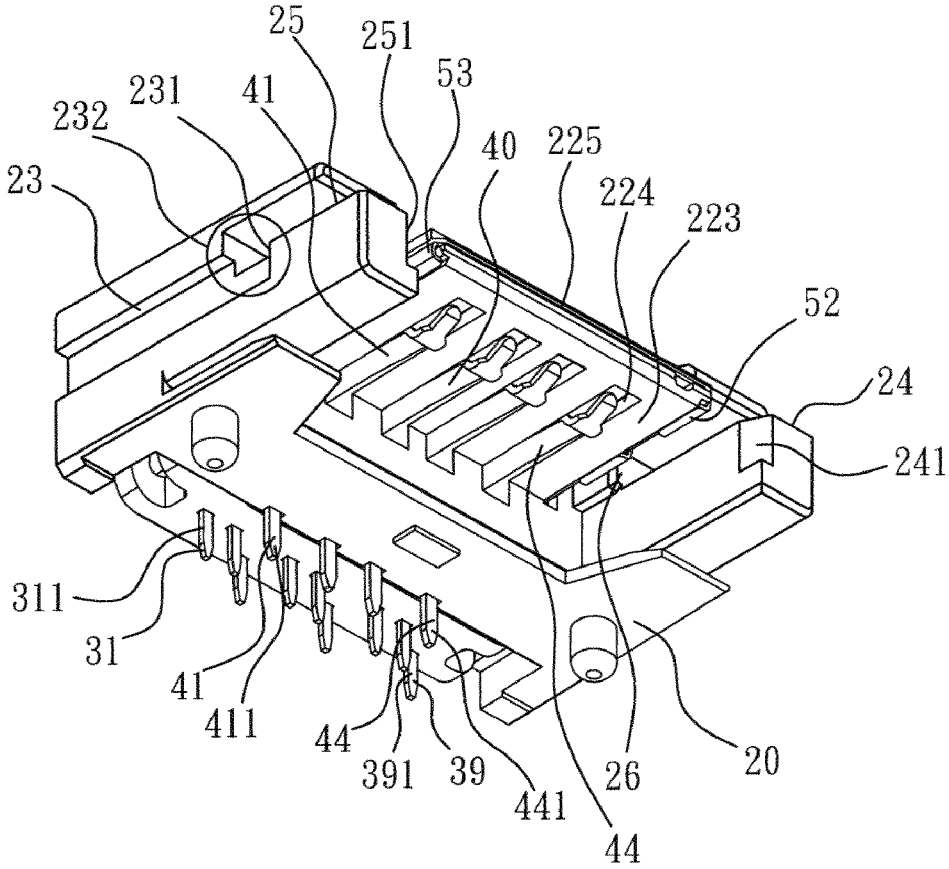
FIG. 2*b* is the perspective bottom view of the legs of the first terminal assembly alternately arranged in a front/end fashion after the base body, the first terminal assembly, and the second terminal assembly being assembled in accordance with the present invention.

With reference to FIG. 2*b*, after the base body 20, the first terminal assembly 30, and the second terminal assembly 40 are being assembled, it is clear that the second terminals 41 to 44 of the second terminal assembly 40 are received in the second terminal slots 224, and the legs 411-441 extend perpendicularly and downward to protrude out of the rear of the housing 10 and are positioned in parallel and stay inside with respect to the contact portions 312 to 392. Furthermore, the inner edge of the step 24 extends inwardly to form a protruding portion 26 to provide restricting function as an USB plug being inserted.

Figure 3:
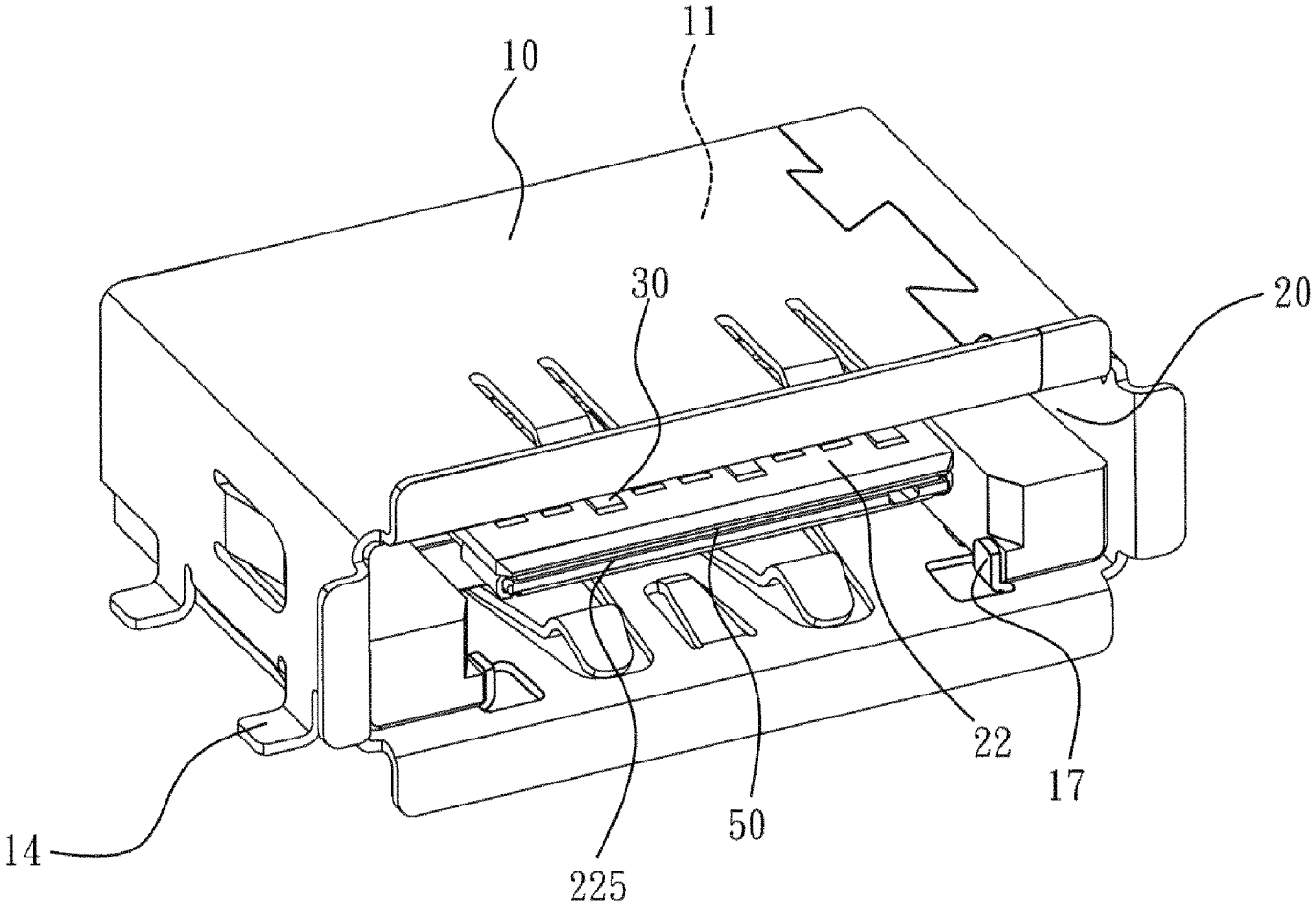
FIG. 3 is an assembled perspective view of a preferred embodiment of an electrical connector in accordance with the present invention.

With reference to FIG. 3, when an electrical connector is being assembled, the first terminal assembly 30 and the terminal assembly 40 are first assembled into the base body 20. Then the ground piece 50 is embeddingly inserted into the gap 225 of the tongue 22. Finally, the base body 20 is placed, from rear toward front, into the receiving space 11 of the housing 10, and the restricting piece 17 is used to restrict and locate the step 24. Consequently, the final assembly is achieved. With the welding piece 14, an electrical connector according to the present invention is finally connected onto the printed circuit board 60.

Figure 4:
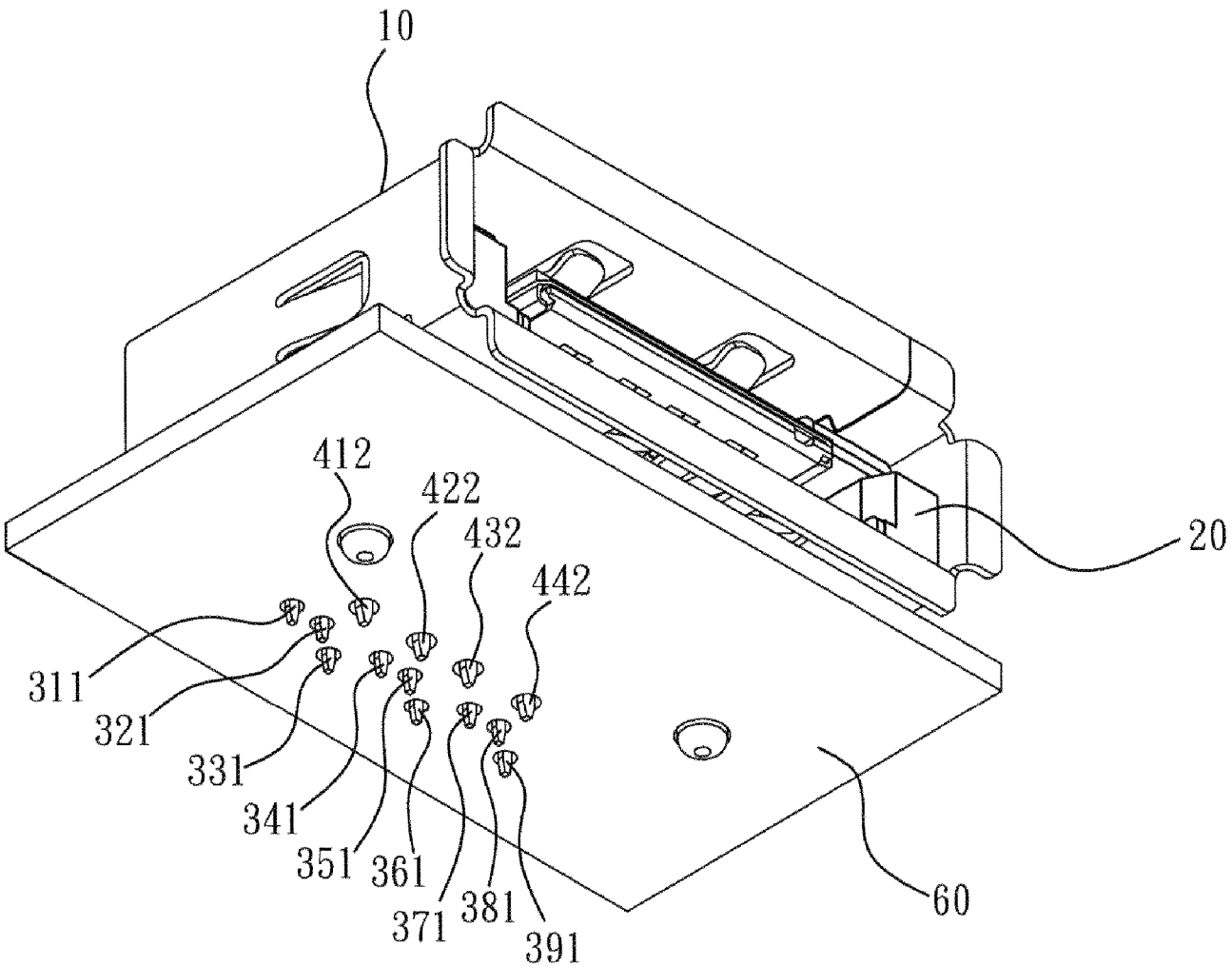
FIG. 4 is an assembled perspective view of the present invention connected with a printed circuit board.

With reference to FIG. 4, an electrical connector is embeddingly inserted onto a printed circuit board 60. Since the legs 311 to 391 are alternately arranged in a front/rear fashion so as to provide a larger spacing therebetween. Layout can then be possible among the legs 311 to 319. Consequently, the printed circuit board 60 has a larger layout space around an electrical connector according to the present invention, so as to provide wiring with more space and higher flexibility when layout is being conducted. As a result, the printed circuit board 60 can be made with smaller area and in turn its cost can be cut down.

In summary, the legs of the first terminal assembly of an electrical connector according to the present invention are alternately arranged in a front/rear fashion to provide larger spacing for wiring during layout. Also, a ground piece is embeddingly inserted into the tongue of the base body, such that the strength of the tongue can be enhanced. Furthermore, the grounding effect and electrical properties can be improved and electrostatic discharge can be prevented. Therefore, an electrical connector according to the present invention is indeed a novelty not seen in conventional art.

The present invention provides a feasible solution, and a patent application is duly filed accordingly. However, it is to be noted that the preferred embodiments disclosed in the specification and the accompanying drawings are not intended to limit the invention. To the contrary, it is intended to cover various modifications and similar arrangements and procedures, and thus the scope of the appended claims should be accorded the broadest interpretation so as to encompass all such modifications and similar arrangements and procedures.

What is claimed is:

1. An electrical connector comprising:

a housing having a receiving space;

a base body inserted into the receiving space and having a tongue, the tongue has a first surface having a plurality of first terminal slots and a second surface having a plurality of second terminal slots;

a first terminal assembly having a plurality of first terminals located in the first terminal slots, respectively, each of the plurality of first terminals has a contact portion and a leg extending downwardly from the contact portion;

a second terminal assembly having a plurality of second terminals located in the second terminal slots, each of the plurality of second terminals has a contact portion and a leg extending downwardly from a first end of the contact portion, each contact portion has a downwardly bent section located on a second end thereof; and a ground piece inserted into a gap of the tongue, a front end of the ground piece extends downwardly forming a contact portion contacting one of the ground terminals of the plurality of first terminals and the plurality of second terminals to achieve the function of grounding and electrostatic discharge (ESD) prevention;

wherein the legs of the plurality of first terminals are alternatively positioned in two sets being the legs of every third first terminal of the plurality of first terminals and the legs of remaining first terminals of the plurality of first terminals, the legs of every third first terminal of the plurality of first terminals are positioned further apart from the legs of the plurality of second terminals than the legs of the remaining first terminals of the plurality of first terminals.

2. The electrical connector as defined in claim 1, wherein the housing is made of metal, the housing has a first opening located in each of two sidewalls thereof, each first opening has a retaining portion formed therein and bent inwardly.

3. The electrical connector as defined in claim 2, wherein the base has a guide slot located in each of two opposing sides thereof, one end of each guide slot has a stopper, the retaining portion of the housing is fixed in the guide slot by the stopper.

4. The electrical connector as defined in claim 3, wherein each guide slot has a restricting portion located adjacent to the stopper, each restricting portion accommodating a corresponding one of the retaining portion and preventing the corresponding one of the retaining portion from moving backwardly.

5. The electrical connector as defined in claim 1, wherein the housing has at least one welding piece located on a bottom of each of the two sidewalls thereof for connecting the housing to a printed circuit board.

6. The electrical connector as defined in claim 1, wherein the first terminal assembly is a terminal assembly of a e-SATA, the contact portions of every third first terminal of the plurality of first terminals are longer than the contact portions of the remaining first terminals of the plurality of first terminals.

7. The electrical connector as defined in claim 1, wherein each third first terminal of the plurality of first terminals is selected from a group consisting of a power terminal and a ground terminal and each of the remaining first terminals of the plurality of first terminals is a signal terminal.

8. The electrical connector as defined in claim 1, wherein the second terminal assembly is a terminal assembly selected from a group consisting of a Universal Serial BUS (USB) and a IEEE 1394, the downwardly bent section located on the second end of the contact portion of each of plurality of second terminals is a stopping portion.

9. The electrical connector as defined in claim 1, wherein the plurality of first terminals includes a ground terminal and signal terminals, and the plurality of second terminals includes a ground terminal, signal terminals, and a power terminal.

10. The electrical connector as defined in claim 1, wherein the ground piece has at least an inserting edge located on each of two sides thereof and engaging two sides of the tongue.

11. The electrical connector as defined in claim 1, wherein the housing has at least one second opening located on each of an upper wall and a lower wall thereof and a ground finger located in each second opening and being bend inwardly.

12. The electrical connector as defined in claim 1, wherein the base body has a step located on each of two sides of the tongue, respectively, and each step is formed to have a chamfer to provide guiding and restricting functions.

13. The electrical connector as defined in claim 12, wherein the housing has two restricting pieces spaced apart and located on a lower wall thereof, the restricting pieces restricting and locating each step of the base body.

14. The electrical connector as defined in claim 12, wherein an inner wall of the step extends inwardly to form a protruding portion to provide a restricting function as an USB plug is inserted.

15. The electrical connector as defined in claim 11, wherein the first terminal slots are formed on a top surface of the tongue and the second terminal slots are formed on a bottom surface of the tongue.

* * * * *